United States Patent [19]

Dulhunty

[11] Patent Number: 4,831,952

[45] Date of Patent: May 23, 1989

[54] ANCHOR

[75] Inventor: Philip W. Dulhunty, Greenwich, Australia

[73] Assignee: Dumison Marine Pty. Ltd., Australia

[21] Appl. No.: 111,510

[22] Filed: Oct. 22, 1987

[30] Foreign Application Priority Data

Oct. 24, 1986 [AU] Australia ..... PH8676

[51] Int. Cl.[4] ..... B63B 21/42

[52] U.S. Cl. ..... 114/309; 114/301; 114/304

[58] Field of Search ..... 114/294, 295, 297, 298, 114/301, 302, 304, 305, 306, 307, 308, 309

[56] References Cited

U.S. PATENT DOCUMENTS

| | | | |
|---|---|---|---|
| 102,584 | 5/1870 | Pattison | 114/306 |
| D. 127,184 | 5/1941 | Northrop . | |
| 2,491,564 | 10/1949 | Iversen | 114/209 |
| 2,720,184 | 10/1955 | Polenz | 114/208 |
| 2,721,530 | 10/1955 | Vorenkamp | 114/294 |
| 2,738,750 | 3/1956 | Vorenkamp | 114/207 |
| 2,797,658 | 7/1957 | Doty, Jr. | 114/208 |
| 2,840,031 | 6/1958 | Kane et al. | 114/304 |
| 3,123,037 | 3/1964 | Jensen | 114/208 |
| 3,295,153 | 1/1967 | Dessau | 9/8 |
| 3,450,088 | 6/1969 | Guier | 114/208 |
| 3,505,969 | 4/1970 | Bowers | 114/208 |
| 3,593,682 | 7/1971 | Zitzow | 114/208 |
| 3,611,974 | 10/1971 | Joppa et al. | 114/206 |
| 3,685,479 | 8/1972 | Bruce | 114/206 |
| 3,742,891 | 7/1973 | Diorio | 114/208 |
| 3,946,695 | 3/1976 | Isaak . | |
| 3,961,451 | 6/1976 | McCain | 114/208 |
| 4,114,554 | 9/1978 | Miller | 114/298 |
| 4,369,727 | 1/1983 | Fasco | 114/297 |
| 4,394,842 | 7/1983 | Van den Haak | 114/304 |
| 4,397,256 | 8/1983 | Bruce | 114/303 |
| 4,704,982 | 11/1987 | Sahlberg | 114/304 |

FOREIGN PATENT DOCUMENTS

| | | |
|---|---|---|
| 565762 | 11/1958 | Canada . |
| 1123832 | 4/1966 | United Kingdom . |
| 0200693 | 4/1986 | European Pat. Off. . |
| 85/05084 | 11/1985 | PCT Int'l Appl. . |
| 667640 | 6/1979 | U.S.S.R. . |
| 1100518 | 1/1968 | United Kingdom . |

*Primary Examiner*—Joseph F. Peters, Jr.
*Assistant Examiner*—Thomas J. Brahan
*Attorney, Agent, or Firm*—Leydig, Voit & Mayer

[57] ABSTRACT

A gliding anchor for mooring a vessel includes a central shank having a weighted forward end and a blade hinged to said shank. The blade is hinged to the shank by means of a pantographic linkage, the rear link being longer than the forward link to provide downward inclination of the blade when in its open position. The blade is provided with a pair of upswept wings extending on either side of the shank which serve to cause the anchor to glide when the blade is deployed in a first position wherein its longitudinal axis lies parallel to that of the shank. These wings are deployed as bottom engaging flukes when the blade is rotated downwards about the hinge to a second open position by a force being applied to the anchor line attached to the rear of the shank.

13 Claims, 5 Drawing Sheets

Figure 3:
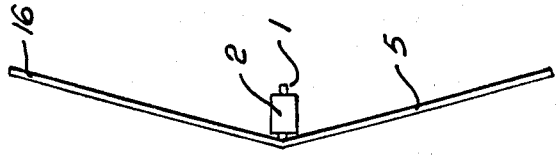

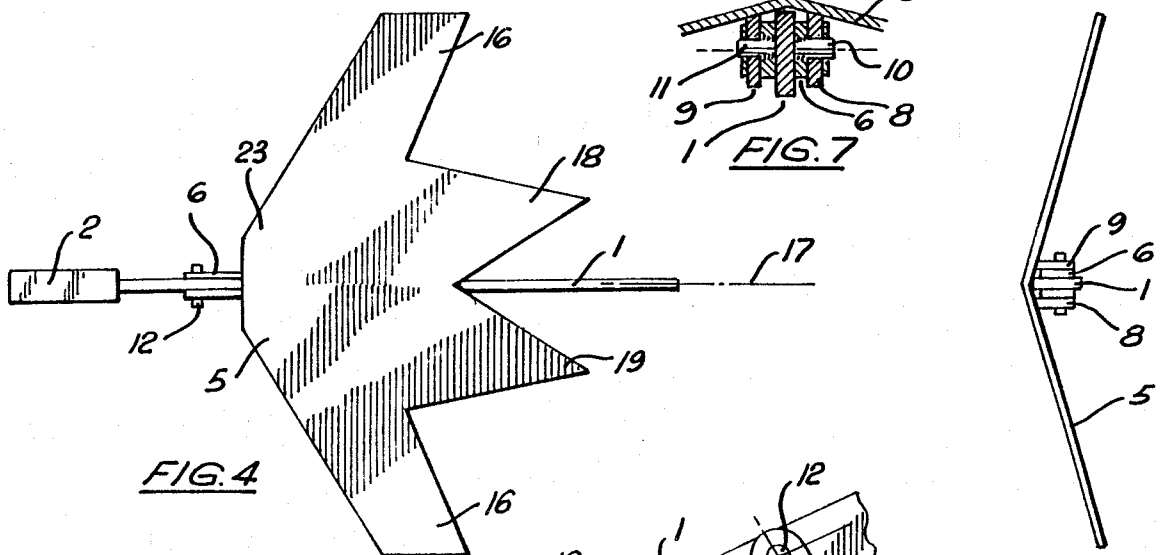
FIG. 4
FIG. 5
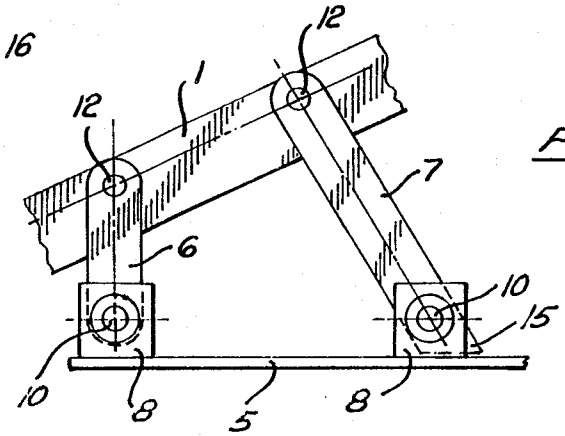
FIG. 6
FIG. 7

ANCHOR

This invention relates to anchors particularly to anchors that are able to "fly" or glide away from a sea going vessel and secure themselves on the seabed.

The usual method of anchoring a vessel is to drop anchor upstream of the desired position and then pay out the anchor cable as the vessel drifts downstream a sufficient distance to enable the anchor to catch on the bottom and hold with a suitably high horizontal component of resistance.

This often requires several attempts before the vessel comes to rest in the desired position. It is particularly awkward when anchoring pleasure craft in a closely spaced group.

Designers have actively sought ways of overcoming this archaic method of dropping anchor. For example U.S. Pat. Nos. 3,611,974, 3,946,695 and 3,295,153 disclose an anchor that can glide away from a vessel; however these examples of the prior art are unfortunately not able to engage the sea bottom with the same load bearing capacity as is provided by the conventional anchors, such as the Danforth anchor.

Even the Danforth anchor sometimes fails to engage the sea bottom when the current is running in the opposite direction to the wind. In this case the blade of the Danforth anchor tends to override the center position and hence present itself like a kite so that it simply floats at the end of its rode, and the pressure of the water prevents the blade from burying into the sea bottom.

One attempt to overcome these disadvantages is shown in EP patent application No. 200693 in the name of Sahlberg and U.K. Pat. No. 1,100,518 in the name of Dial. These specifications disclose anchors with improved sea bottom engagement however they still have problems providing effective engagement under all conditions.

It is an object of the present invention and its preferred embodiments to ameliorate the above discussed disadvantages by providing an anchor which will move away from a vessel in a horizontal direction and also provide adequate securing means for the vessel.

According to one aspect of the invention there is provided an anchor comprising a central elongate shank having a weighted forward end and means at its rear end for attaching an anchor line, a blade having a longitudinal axis and a pair of bottom engaging upswept wings extending outwardly on either side of said axis, said blade being hingedly mounted to said shank by a linkage arrangement including a front link and a corresponding longer rear link for rotation beneath said link about an axis transverse to said shank and said longitudinal axis, means on said blade for engaging said shank to positively limit the maximum extent of rotation of said blade away from said shank, said blade being rotatable with respect to said shank from a first position in which said shank can rest on said blade with said longitudinal axis substantially parallel with said shank, to a second position defined by said maximum extent of rotation, the arrangement permitting said shank to rest on said blade in said first position and move forwardly on said wings away from a vessel as the anchor sinks to the bottom, whereupon rearward force applied to the anchor line causes said blade to assume said second position and securely engage the sea bottom.

The advantages of this type of anchor, are that firstly by "flying" the anchor in the upstream direction it will "fly" into the seabed upstream of the vessel thereby allowing the vessel to remain approximately above its desired position. Secondly if the anchor is let go downstream the velocity of the current will carry the anchor on until the end of its rode whereupon the anchor opens out like a pantograph and the blade sinks into the seabed (or anchorage bottom) holding the vessel fast.

The blade of this anchor has been designed firstly to prevent the anchor from rolling on its back and secondly to direct flow so that the pressure of the water exerts a downward force driving it into the seabed.

In one embodiment, the means on the blade for engaging the link and positively limiting the maximum extent of relative rotation may comprise the base of a slot extending along the longitudinal blade axis from a point near the axis of rotation. The slot is open at its rearward end to permit the link to move through the slot on relative rotation until it abuts the blade at the end of the slot.

For preference the forward end of the anchor is weighted and is hydrodynamically designed so that a downward pressure is exerted on the shank during forward motion thereof, thus preventing the anchor from opening out. Accordingly while the anchor is in the closed position the underside of the weighted forward end extends below the level of the blade so that as the anchor hits the seabed it opens to beyond the overcentre position thereby enabling the linkage to open and allow the blade to sink well into the seabed as the strain in the anchor line is taken up. The anchor is designed so that when fully open the blade penetrates the seabed at a angle to the shank of approximately 30°.

Preferably the hinge is so arranged that an upward or rearward pull on the rear end of the shank will open the anchor out. However it is preferable that when the anchor is in the closed position the shank and the hinge lie within the dyhedral angle of the wings thereby providing a low center of gravity resulting in the greater stability of the anchor in its flying mode.

Figure 1:
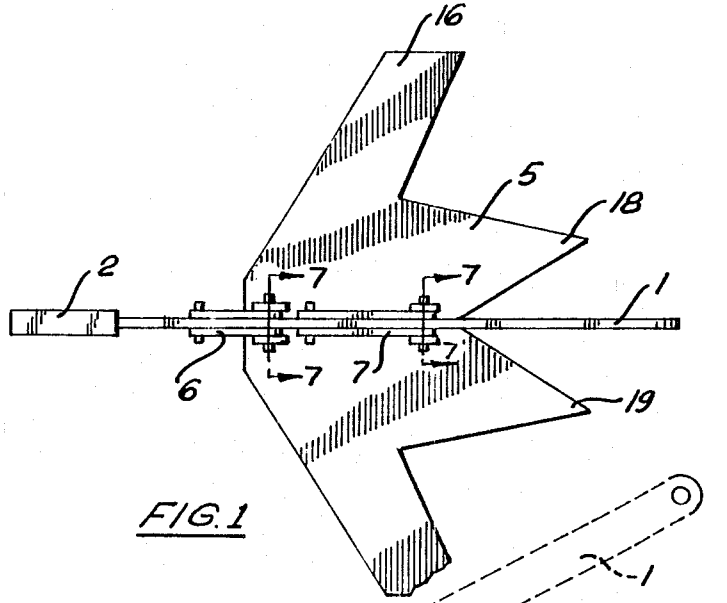
Figure 2:
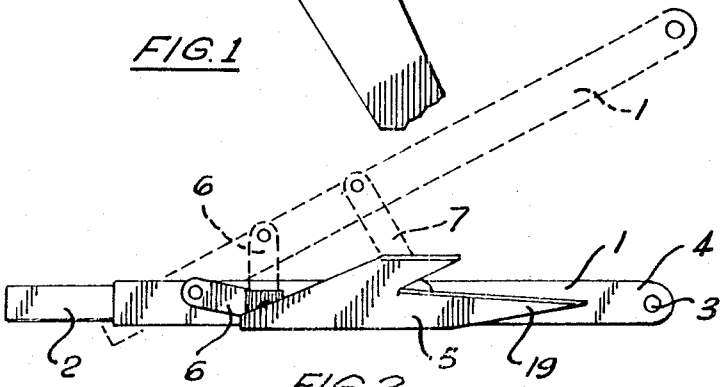
Figure 8:
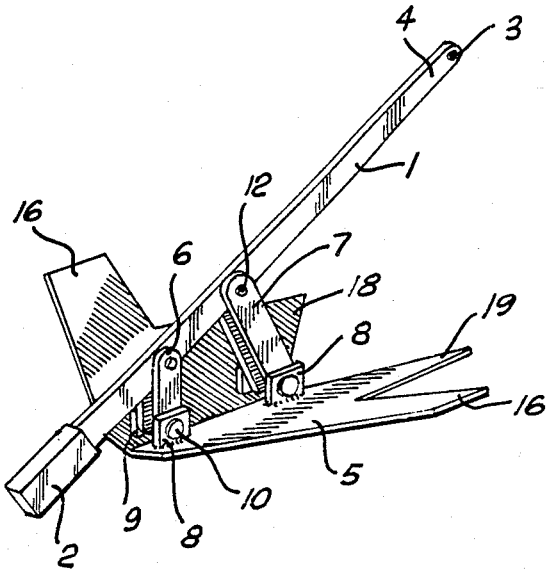
Figure 14:
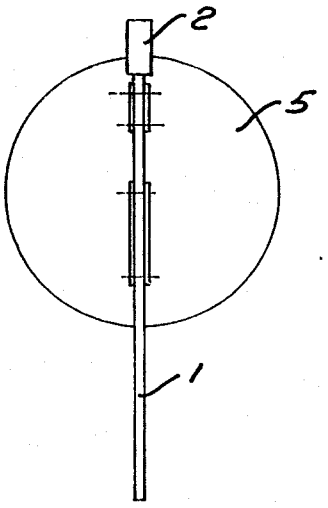
Figure 13:
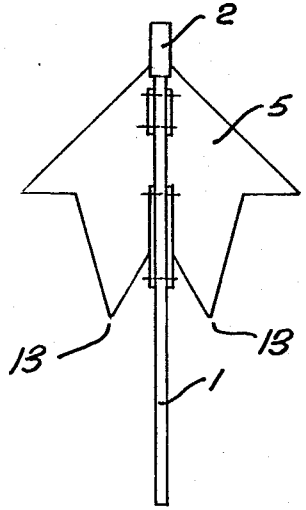

Preferred embodiments of the invention will now be described, by way of example only, with reference to the accompanying drawings in which:

FIG. 1 is a plan view of a first embodiment of the anchor according to the invention, FIG. 2 is a side elevation of the anchor shown in FIG. 1, showing the hinging of the blade with respect to the shank, FIG. 3 is a front elevation of the anchor of FIG. 1, FIG. 4 is an underside view of the anchor of FIG. 1, FIG. 5 is a rear elevation of the anchor of FIG. 1, FIG. 6 is an enlarged fragmentary section showing the hinging of the blade with respect to the shank. The blade is shown in its fully open position, as also shown in FIG. 8, FIG. 7 is a sectional view taken on lines 7—7 of FIG. 1, FIG. 8 is a perspective view of the anchor showing the blade in its fully open, bottom engaging position, FIG. 9 is a schematic side elevation of the anchor according to the invention with the blade in the fully closed position, FIG. 10 shows the blade of the second anchor of FIG. 9 in a partly hinged configuration, FIG. 11 shows the blade in its fully open position, FIG. 12 is a plan view of the second embodiment of the anchor, FIG. 13 is a plan view of a third embodiment anchor, FIG. 14 is a plan view of a fourth embodiment anchor.

Referring initially to FIGS. 1 to 7 of the drawings, the first embodiment anchor includes a central elongate shank 1 having a weighted forward end 2 and a hole 3 at its rear end 4 for attaching an anchor line (not shown). A blade 5 is hingedly connected to the shank by a linkage arrangement including an identical pair of front links 6 and a corresponding pair of longer rear links 7.

Figure 9:
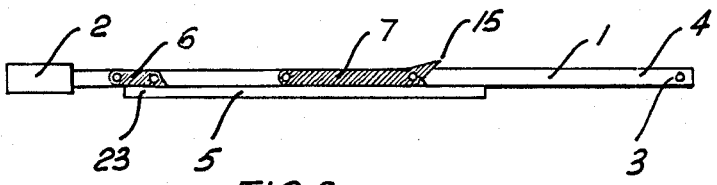
Figure 10:
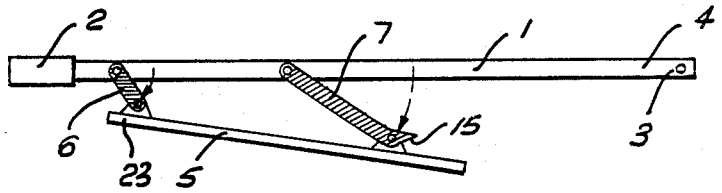
Figure 11:
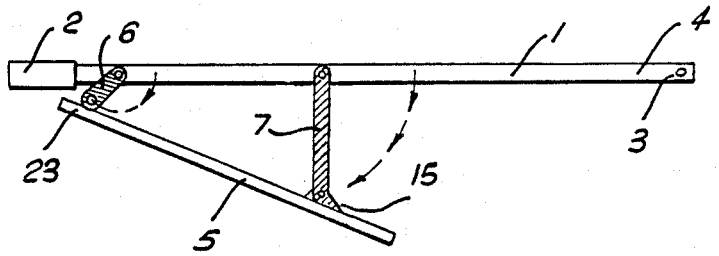
Figure 12:
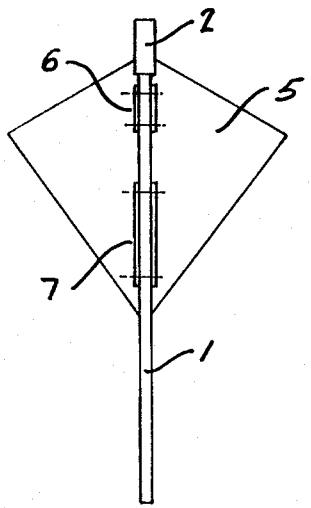

All the links are rotatably mounted at their ends and the unequal lengths of the front and rear links is such that the blade can hinge between the first position shown in FIG. 9, through the intermediate position of FIG. 10 to the second position of maximum rotation with respect to the shank, as shown in FIG. 11. As best shown in FIG. 7, the links are rotatably mounted on the blade by a pair of attachment flanges 8 and 9 which support a pair of co-axial hinge bolts 10 and 11 which define the axis of rotation of each link with respect to the blade. The hinge bolts 10 and 11 extend inwardly from each flange 8 and 9 and support the links which are spaced from one another by approximately the width of the shank. This enables the shank in the closed position to lie between the links and against the blade as shown in FIG. 2. At their other extremity the links are connected to the shank by a support pin 12 which extends outwardly on either side of the shank so that each link of the pair of links are mounted on either side of the shank. Again this allows the shank to move between the links when placed in the closed position. An abutting toe portion 15 on one or both of the rear links 7 engages the blade to limit the extent of rotation. This is preferably of the order of 27 to 33 degrees.

The extent of rotation of the blade may also be limited by extending the toe portion 15 of the rear link 7 through a slot provided in the blade such that as the blade rotates the toe portion 15 bears against the end of the slot or a stop positioned therein to limit further rotation thereof. This arrangement has a further advantage in that the slot acts to limit sideways movement of the link so that nuts or retaining pins are not required to hold the link in position.

The open slot prevents build-up of sand which would otherwise clog the mechanism and prevent the blade from hinging, thereby preventing the anchor from securely engaging the sea bottom. This is particularly important in sandy bottom conditions.

The blade 5 includes a pair of upswept wings 16 which extend symmetrically outwardly and rearwardly on either side of the longitudinal blade axis 17. In this embodiment, the blade wings are provided with two swallow tail points or flukes 18 and 19 which restrain the blade from rolling to one side as it may do with a central fluke and permits easier penetration into cohesive soils. Preferably, the flukes may be inclined slightly downwardly to assist in engaging the bottom.

It will be appreciated that the axis of rotation in this embodiment is not fixed with respect to the shank and the forward end 23 of the blade ends up spaced downwardly away from the shank in the position of maximum rotation, as shown in FIG. 11.

The position of maximum rotation is arranged to maintain the forward end 23 spaced downwardly from the shank as this has been found to improve the engagement of the blade. That is, contact between the blade and shank is prevented and in this way the load applied to the anchor is transferred primarily through the shank and rear links and not to the leading edge of the blade. If the load is applied to the front of the blade the anchor tends to rotate about the flukes and not dig into the seabed. By holding the blade 5 spaced from the shank 1, the force applied to the shank tends to cause the blade 5 to dig into the seabed rather than pivot about the flukes.

It has been found that such an arrangement provides stronger bottom engagement since rearward tension on the shank drives the rear end of the blade more securely into engagement with the bottom with less total angular rotation.

In operation, an anchor line is attached to the rear end 4 of the shank and the anchor is dropped into the water with the shank resting on the blade in its first position as best shown in FIG. 2. The blade then supports the shank and propels the anchor forward through the water in a gliding motion as the anchor sinks.

The weight of the blade rearward of the hinge axes would ordinarily hinge it automatically into its fully open second position. However, its gliding characteristics under water keep it in a generally horizontal position while the anchor is moving through the water.

The wings bring the anchor to rest on the sea bottom a substantial distance away from its point of entry to the water, depending upon the water depth and glide angle. Tests have produced glide angles of the order of 5:1.

Once the anchor has reached the sea bottom, the blade tends to hinge away from the shank under its own weight. Rearward tension applied to the anchor line moves the blade into its position of maximum rotation in which it firmly engages the rear-links as shown in FIG. 6 and securely engages the sea bottom.

To assist opening of the anchor and prevent locking of the pantographic linkage on reaching the sea bottom the forward end 2 of the shank 1, in one embodiment, extends below the level of the blade 5 such that upon contact of the forward end 2 with the sea bottom the shank tends to pivot about the forward end resulting in the blade moving to its open position. Alternatively, the support pins 12 may be mounted above the center line of the shank 1 as best shown in FIG. 6. This arrangement again prevents locking of the linkage in the closed position.

The anchor may be constructed of any suitable heavy material or combination of materials which will provide the necessary strength.

The blades of the anchor of FIGS. 12; 13 and 14 are planar but it will be appreciated that in other embodiments those blades may have their side wings upswept similarly to the blades of the FIG. 1 embodiment.

According to still other embodiments of the invention the blade is hinged at or near its front edge to the shank and the extent to which it may move away from the shank into its second position is limited by a link similar to the link 7 but slotted longitudinally to permit the blade to lie against the shank as the anchor descends to the bottom. Alternatively, but less preferably, such a link may be replaced by a length of chain or other collapsible tensile member.

In a further embodiment, it is preferable to arrange the attachment points of the links of the embodiment so that the pantograph linkage formed thereby goes overcentre when the anchor is in a closed position so as to restrict the pantograph from opening when the anchor is being launched or in flight.

The first embodiment is preferred for use with a forward propelling wing arrangement as described above but may also be applied to conventional anchors with a rotatable blade but with no forward movement characteristics.

Other forward propelling blades that may be used with the embodiment are shown in FIGS. 12 to 14. With the superior ground engagement characteristics of the second embodiment, the rear of the blade does not require special rearwardly extending ground engaging formations like the flukes 18 and 19, although these are preferred for added security.

The linkage may also be provided with means to lock the pantograph in its open position when not required to be "flown" away from the vessel, for example, when it is lowered over the side of the vessel in the normal manner.

Although the invention has been described with reference to specific examples, it will be appreciated by those skilled in the art that the invention may be embodied in many other forms.

I claim:

1. An anchor for mooring a vessel comprising:

a central elongated shank having a weighted forward end and a rear end to be attached to an anchor line;

a blade having a longitudinal axis and a pair of bottom engaging upswept wings extending outwardly on either side of said longitudinal axis;

a linkage arrangement hingedly linking said blade to said shank, and including a front link and a corresponding longer rear link rotating beneath said shank about an axis transverse to said shank and said longitudinal axis, said front and rear links each having a substantially identical pair of links; and engaging means mounted on said blade for engaging either said front or rear link or both pairs of said links to positively limit a maximum extent of rotation of said blade away from said shank, said blade being rotatable with respect to said shank from a first position in which said shank can rest on said blade with said longitudinal axis substantially parallel with said shank to a second position defined by the maximum extent of rotation, said linkage arrangement permitting said shank to rest on said blade in said first position and move forwardly on said wings away from the vessel as said anchor sinks downward to an anchorage bottom, whereupon rearward force applied to the anchor line causes said blade to assume said second position and securely engage the anchorage bottom.

2. An anchor according to claim 1 wherein said upswept wings of said blade extend symmetrically outwardly and rearwardly on either side of said longitudinal axis of said blade.

3. An anchor according to claim 1 wherein said blade further includes rearwardly directed flukes to restrain said blade from rolling to one side upon engaging with the anchorage bottom.

4. An anchor according to claim 3 wherein said upswept wings of said blade include respective tail ends extending symmetrically on either side of said shank to form one set of said flukes.

5. An anchor for mooring a vessel comprising:

a central elongated shank having a weighted forward end and a rear end to be attached to an anchor line;

a blade having a longitudinal axis and a pair of bottom engaging upswept wings extending outwardly on either side of said longitudinal axis;

a linkage arrangement hingedly linking said blade to said shank, and including a front link and a corresponding longer rear link rotating beneath said shank about an axis transverse to said shank and said longitudinal axis, said front and rear links each having a substantially identical pair of links; and engaging means mounted on said blade for engaging either said front or rear link to positively limit a maximum extent of rotation of said blade away from said shank, said engaging means including a base of a slot extending along said longitudinal axis from a point near said axis of rotation, said slot being open at a rearward end to permit said links to move through said slot upon relative rotations of said links until said links abut said blade at said rearward end of said slot, said blade being rotatable with respect to said shank from a first position in which said shank can rest on said blade with said longitudinal axis substantially parallel with said shank to a second position defined by the maximum extent of rotation, said linkage arrangement permitting said shank to rest on said blade in said first position and move forwardly on said wings away from the vessel as said anchor sinks downward to an anchorage bottom, whereupon rearward force applied to the anchor line causes said blade to assume said second position and securely engage the anchorage bottom.

6. An anchor for mooring a vessel comprising:

a central elongated shank having a weighted forward end and a rear end to be attached to an anchor line;

a blade having a longitudinal axis and a pair of bottom engaging upswept wings extending outwardly on either side of said longitudinal axis;

a linkage arrangement hingedly linking said blade to said shank, and including a front link and a corresponding longer rear link rotating beneath said shank about an axis transverse to said shank and said longitudinal axis; and engaging means mounted on said blade for engaging either said front or rear link to positively limit a maximum extent of rotation of said blade away from said shank, said blade being rotatable with respect to said shank from a first position in which said shank can rest on said blade with said longitudinal axis substantially parallel with said shank to a second position defined by the maximum extent of rotation, said linkage arrangement permitting said shank to rest on said blade in said first position and move forwardly on said wings away from the vessel as said anchor sinks downward to an anchorage bottom, whereupon rearward force applied to the anchor line causes said blade to assume said second position and securely engage the anchorage bottom, said weighted forward end has a portion which extends below said blade when said blade is in said first position such that, upon contact of said forward end with the anchorage bottom, said shank tends to pivot about said forward end, causing said blade to rotate to said second position.

7. An anchor according to claim 6 wherein said front and rear links of said linkage arrangement are rotatably mounted at respective ends and have predetermined lengths such that said blade can hinge between said first position and said second position of maximum extent of rotation with respect to said shank, said blade being held spaced from said shank when in said second position.

8. An anchor according to claim 7 wherein said engaging means includes an abutting toe portion on one or both of said rear links engageable with said blade to limit the extent of rotation to between 27 and 33 degrees.

9. An anchor according to claim 7 wherein said linkage arrangement formed by said front and rear links moves to an overcenter position when said blade rotates to said second position.

10. An anchor for mooring a vessel comprising:

a central elongated shank having a weighted forward end and a rear end to be attached to an anchor line;

a blade having a longitudinal axis and a pair of bottom engaging upswept wings extending outwardly on either side of said longitudial axis;

a linkage arrangement hingedly linking said blade to said shank, and including a front link and a corresponding longer rear link rotating beneath said shank about an axis transverse to said shank and said longitudinal axis; and engaging means mounted on said blade for engaging either said front or rear link to positively limit a maximum extent of rotation of said blade away from said shank, said engaging means including a base of a slot extending along said longitudinal axis from a point near said axis of rotation, said slot being open at a rearward end to permit said links to move through said slot upon relative rotations of said links until said links abut said blade at said rearward end of said slot, said blade being rotatable with respect to said shank from a first position in which said shank can rest on said blade with said longitudinal axis substantially parallel with said shank to a second position defined by the maximum extent of rotation, said linkage arrangement permitting said shank to rest on said blade in said first position and move forwardly on said wings away from the vessel as said anchor sinks downward to an anchorage bottom, whereupon rearward force applied to said anchor line causes said blade to assume said second position and securely engage the anchorage bottom, said weighted forward end having a portion which extends below said blade when said blade is in said first position such that, upon contact of said forward end with the anchorage bottom, said shank tends to pivot about said forward end, causing said blade to rotate to said second position.

11. An anchor according to claim 10 wherein said front and rear links of said linkage arrangement are rotatably mounted at respective ends and have predetermined lengths such that said blade can hinge between said first position and said second position of maximum extent of rotation with respect to said shank, said blade being held spaced from said shank when in said second position.

12. An anchor according to claim 11 wherein said engaging means includes an abutting toe portion on one or both of said rear links engageable with said blade to limit the extent of rotation to between 27 and 33 degrees.

13. An anchor according to claim 11 wherein said linkage arrangement formed by said front and rear links moves to an overcenter position when said blade rotates to said second position.

* * * * *